US005802774A

United States Patent [19]

Kardacz

[11] Patent Number: 5,802,774

[45] Date of Patent: Sep. 8, 1998

[54] GUTTER CLEANING SYSTEM

[76] Inventor: Joseph S. Kardacz, 238 Willard Dr., Ridley Park, Pa. 19078

[21] Appl. No.: 911,099

[22] Filed: Aug. 14, 1997

[51] Int. Cl.[6] ..... E04D 13/04

[52] U.S. Cl. ..... 52/11; 241/260.1; 15/246; 52/16

[58] Field of Search ..... 52/11, 12, 15, 52/16; 15/246; 241/260.1, 199.12; 198/642; 406/135

[56] References Cited

U.S. PATENT DOCUMENTS

| | | | |
|---|---|---|---|
| 3,301,605 | 1/1967 | Greenway | 406/135 X |
| 3,602,394 | 8/1971 | McCune | 406/135 X |
| 3,817,498 | 6/1974 | Frankfurth et al. | 198/642 X |
| 3,937,522 | 2/1976 | Korn et al. | 406/135 |
| 5,305,562 | 4/1994 | Sapia | 52/11 X |
| 5,357,719 | 10/1994 | Lewis | 52/11 |

*Primary Examiner*—Lanna Mai

[57] ABSTRACT

A new gutter cleaning system for eliminating a need to manually clean gutters. The inventive device includes a motor disposed within a gutter at an end thereof opposite a downspout opening thereof. The motor is disposed within a waterproof housing. The motor has a rotating coupling rod extending outwardly thereof and extending outwardly of a side wall of the housing. The motor has a power cord extending outwardly thereof and extending outwardly of a top wall of the housing. A spindle shaft couples with the rotating coupling rod of the variable speed motor. The shaft extends essentially a length of the gutter. A plurality of fan blades are coupled with the spindle shaft in a spaced relationship.

4 Claims, 2 Drawing Sheets

GUTTER CLEANING SYSTEM

BACKGROUND OF THE INVENTION

1. Field of the Invention

The present invention relates to self-cleaning gutters and more particularly pertains to a new gutter cleaning system for eliminating a need to manually clean gutters.

2. Description of the Prior Art

The use of self-cleaning gutters is known in the prior art. More specifically, self-cleaning gutters heretofore devised and utilized are known to consist basically of familiar, expected and obvious structural configurations, notwithstanding the myriad of designs encompassed by the crowded prior art which have been developed for the fulfillment of countless objectives and requirements.

Known prior art self-cleaning gutters include U.S. Pat. No. 4,634,312 to Sterzel; U.S. Pat. No. 4,709,516 to Gleaves; U.S. Pat. No. Des. 353,189 to Crowley; U.S. Pat. No. 4,718,613 to Moomaw; U.S. Pat. No. 4,402,106 to Mattson; and U.S. Pat. No. 4,121,320 to Feiner.

While these devices fulfill their respective, particular objectives and requirements, the aforementioned patents do not disclose a new gutter cleaning system. The inventive device includes a motor disposed within a gutter at an end thereof opposite a downspout opening thereof. The motor is disposed within a waterproof housing. The motor has a rotating coupling rod extending outwardly thereof and extending outwardly of a side wall of the housing. The motor has a power cord extending outwardly thereof and extending outwardly of a top wall of the housing. A spindle shaft couples with the rotating coupling rod of the variable speed motor. The shaft extends essentially a length of the gutter. A plurality of fan blades are coupled with the spindle shaft in a spaced relationship.

In these respects, the gutter cleaning system according to the present invention substantially departs from the conventional concepts and designs of the prior art, and in so doing provides an apparatus primarily developed for the purpose of eliminating a need to manually clean gutters.

SUMMARY OF THE INVENTION

In view of the foregoing disadvantages inherent in the known types of self-cleaning gutters now present in the prior art, the present invention provides a new gutter cleaning system construction wherein the same can be utilized for eliminating a need to manually clean gutters.

The general purpose of the present invention, which will be described subsequently in greater detail, is to provide a new gutter cleaning system apparatus and method which has many of the advantages of the self-cleaning gutters mentioned heretofore and many novel features that result in a new gutter cleaning system which is not anticipated, rendered obvious, suggested, or even implied by any of the prior art self-cleaning gutters, either alone or in any combination thereof.

To attain this, the present invention generally comprises a gutter having a predetermined length. The gutter has an open top, a closed bottom, opposed long side portions and opposed short end portions. The closed bottom has a downspout opening adjacent one of the short end portions. The gutter is positionable on a house. A variable speed motor is disposed within the gutter at an end thereof opposite the downspout opening. The motor is disposed within a waterproof housing. The motor has a rotating coupling rod extending outwardly thereof and extending outwardly of a side wall of the housing. The motor has a power cord extending outwardly thereof and extending outwardly of a top wall of the housing. A spindle shaft couples with the rotating coupling rod of the variable speed motor. The shaft extends essentially the length of the gutter. A plurality of supports are secured to the closed bottom of the gutter in a spaced relationship. Upper ends of the supports couple with the spindle shaft. The upper ends have bushings disposed therein so as not to preclude rotation of the spindle shaft. A plurality of fan blades are coupled with the spindle shaft in a spaced relationship. Each of the fan blades comprises a central circular coupling portion coupled to the spindle shaft and four radially extending blades.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new gutter cleaning system apparatus and method which has many of the advantages of the self-cleaning gutters mentioned heretofore and many novel features that result in a new gutter cleaning system which is not anticipated, rendered obvious, suggested, or even implied by any of the prior art self-cleaning gutters, either alone or in any combination thereof.

It is another object of the present invention to provide a new gutter cleaning system which may be easily and efficiently manufactured and marketed.

It is a further object of the present invention to provide a new gutter cleaning system which is of a durable and reliable construction.

An even further object of the present invention is to provide a new gutter cleaning system which is susceptible of a low cost of manufacture with regard to both materials and labor, and which accordingly is then susceptible of low prices of sale to the consuming public, thereby making such gutter cleaning system economically available to the buying public.

Still yet another object of the present invention is to provide a new gutter cleaning system which provides in the apparatuses and methods of the prior art some of the advantages thereof, while simultaneously overcoming some of the disadvantages normally associated therewith.

Still another object of the present invention is to provide a new gutter cleaning system for eliminating a need to manually clean gutters.

Yet another object of the present invention is to provide a new gutter cleaning system which includes a motor disposed within a gutter at an end thereof opposite a downspout opening thereof. The motor is disposed within a waterproof housing. The motor has a rotating coupling rod extending outwardly thereof and extending outwardly of a side wall of the housing. The motor has a power cord extending outwardly thereof and extending outwardly of a top wall of the housing. A spindle shaft couples with the rotating coupling rod of the variable speed motor. The shaft extends essentially a length of the gutter. A plurality of fan blades are coupled with the spindle shaft in a spaced relationship.

Still yet another object of the present invention is to provide a new gutter cleaning system that makes it easy to clean gutters without having to leave the ground Even still another object of the present invention is to provide a new gutter cleaning system that eliminates the need of climbing up and down a ladder.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
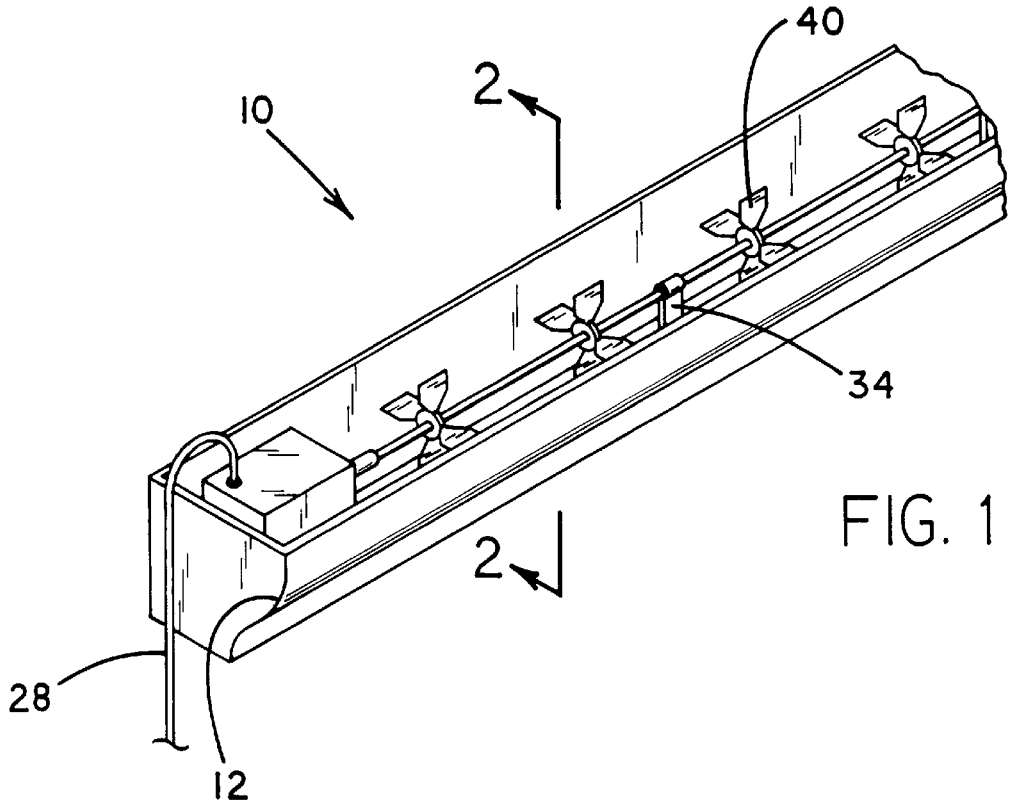
FIG. 1 is a perspective view of a new gutter cleaning system according to the present invention.
Figure 2:
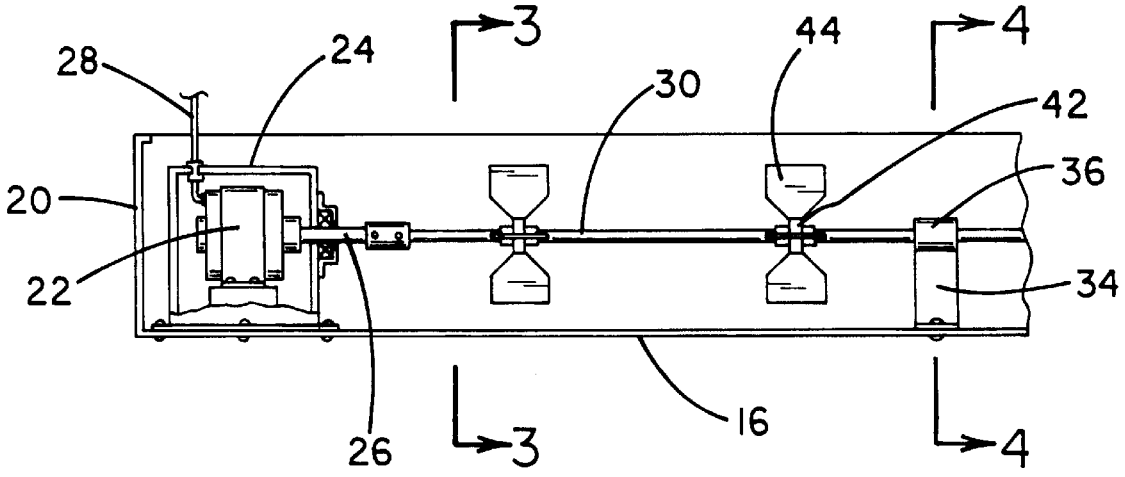
FIG. 2 is a cross-sectional view of the present invention as taken along line 2—2 of FIG. 1.
Figure 3:
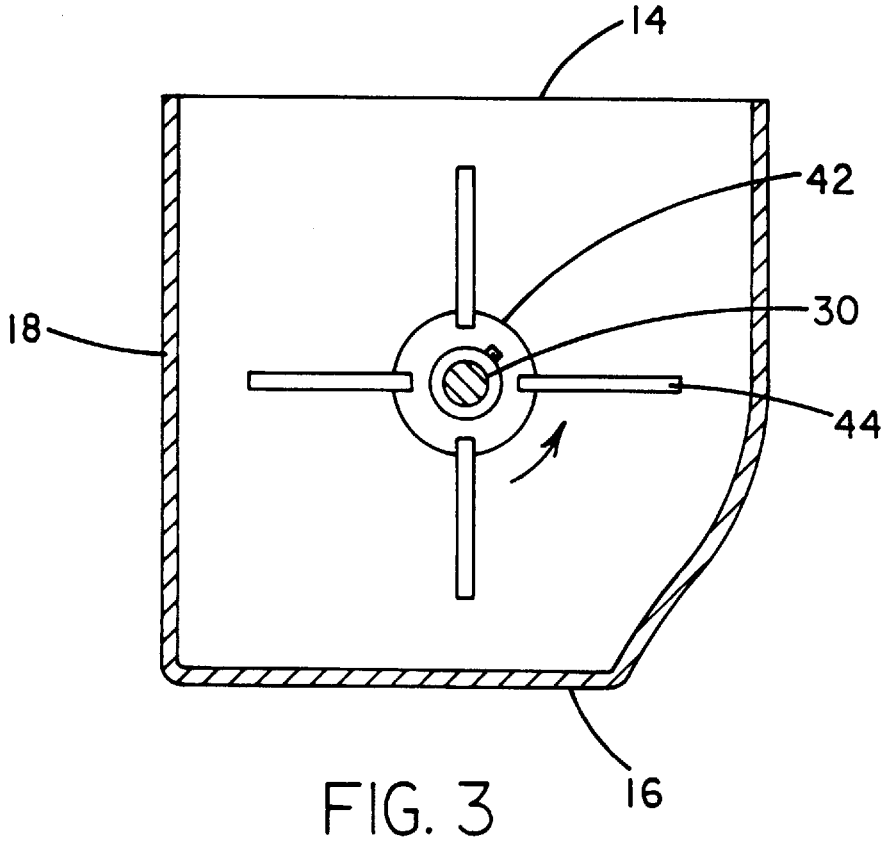
FIG. 3 is a cross-sectional view of the present invention as taken along line 3—3 of FIG. 2.
Figure 4:
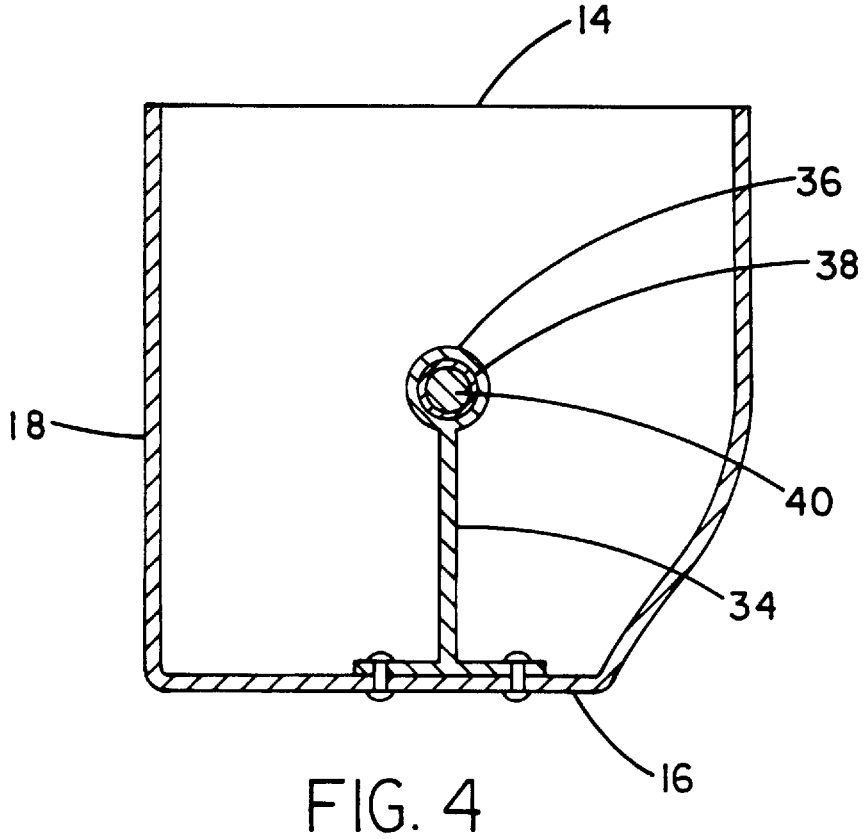
FIG. 4 is a cross-sectional view of the present invention as taken along line 4—4 of FIG. 2.

With reference now to the drawings, and in particular to FIGS. 1 through 4 thereof, a new gutter cleaning system embodying the principles and concepts of the present invention and generally designated by the reference numeral 10 will be described.

As best illustrated in FIGS. 1 through 4, the gutter cleaning system 10 comprises a gutter 12 having a predetermined length. The gutter 12 has an open top 14, a closed bottom 16, opposed long side portions 18 and opposed short end portions 20. The closed bottom 16 has a downspout opening (not illustrated) adjacent one of the short end portions 20. The gutter 12 is positionable on a house.

A variable speed motor 22 is disposed within the gutter 12 at an end thereof opposite the downspout opening. The motor 22 is disposed within a waterproof housing 24. The motor 22 has a rotating coupling rod 26 extending outwardly thereof and extends outwardly of a side wall of the housing 24. The motor 22 has a power cord 28 extending outwardly thereof and extends outwardly of a top wall of the housing 24. The power cord 28 will couple with a standard electrical outlet or the like. A power switch can be incorporated into the power cord to selectively activate the motor 22. The power switch will have controls to vary the speed of the motor 22.

A spindle shaft 30 couples with the rotating coupling rod 26 of the variable speed motor 22. The shaft 30 extends essentially the length of the gutter 12.

A plurality of supports 34 are secured to the closed bottom 16 of the gutter 12 in a spaced relationship. Upper ends 36 of the supports 34 couple with the spindle shaft 30. The upper ends 36 have bushings 38 disposed therein so as not to preclude rotation of the spindle shaft 30.

A plurality of fan blades 40 are coupled with the spindle shaft 30 in a spaced relationship. Each of the fan blades 40 comprises a central circular coupling portion 42 coupled to the spindle shaft 30 and four radially extending blades 44.

In use, the device 10 could be used to clean gutters without the user having to leave the ground. The user would simply flip the power switch and allow the motor 22 to operate at the desired speed (high, medium, or low) for a few minutes. The fan blades 40 would lift any debris, twigs, leaves, sludge, or even standing water out of the gutter 12 and drop it onto the ground below. Once material stopped falling out of the gutter 12, the user would simply turn off the motor 22 and use a rake or shovel to clean up the gutter debris and dispose of it as usual.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A gutter cleaning system for eliminating a need to manually clean gutters comprising, in combination:

a gutter having a predetermined length, the gutter having an open top, a closed bottom, opposed long side portions and opposed short end portions, the closed bottom having a downspout opening adjacent one of the short end portions, the gutter positionable on a house;

a variable speed motor disposed within the gutter at an end thereof opposite the downspout opening, the motor being disposed within a waterproof housing, the motor having a rotating coupling rod extending outwardly thereof and extending outwardly of a side wall of the housing, the motor having a power cord extending outwardly thereof and extending outwardly of a top wall of the housing;

a spindle shaft coupling with the rotating coupling rod of the variable speed motor, the shaft extending essentially the length of the gutter;

a plurality of supports secured to the closed bottom of the gutter in a spaced relationship, upper ends of the supports coupling with the spindle shaft, the upper ends having bushings disposed therein so as not to preclude rotation of the spindle shaft; and a plurality of fan blades coupled with the spindle shaft in a spaced relationship, each of the fan blades comprising a central circular coupling portion coupled to the spindle shaft and four radially extending blades.

2. A gutter cleaning system for eliminating a need to manually clean gutters comprising, in combination:

a gutter positionable on a house, and includes a downspout at one end;

a motor disposed within a gutter at an end thereof opposite a downspout opening thereof, the motor being disposed within a waterproof housing, the motor having a rotating coupling rod extending outwardly thereof and extending outwardly of a side wall of the housing, the motor having a power cord extending outwardly thereof and extending outwardly of a top wall of the housing;

a spindle shaft coupling with the rotating coupling rod of the variable speed motor, the shaft extending essentially a length of the gutter; and a plurality of fan blades coupled with the spindle shaft in a spaced relationship.

3. The gutter cleaning system as set forth in claim 2 and further including a plurality of supports secured to a closed bottom of the gutter in a spaced relationship, upper ends of the supports coupling with the spindle shaft, the upper ends each having bushings disposed therein so as not to preclude rotation of the spindle shaft.

4. The gutter cleaning system as set forth in claim 2 wherein each of the fan blades comprises a central circular coupling portion coupled to the spindle shaft and four radially extending blades.

* * * * *